US010749266B2

(12) United States Patent
Mizzoni et al.

(10) Patent No.: US 10,749,266 B2
(45) Date of Patent: Aug. 18, 2020

(54) DOUBLE-REFLECTOR ANTENNA AND RELATED ANTENNA SYSTEM FOR USE ON BOARD LOW-EARTH-ORBIT SATELLITES FOR HIGH-THROUGHPUT DATA DOWNLINK AND/OR FOR TELEMETRY, TRACKING AND COMMAND

(71) Applicant: Thales Alenia Space Italia S.p.A Con Unico Socio, Rome (IT)

(72) Inventors: Roberto Mizzoni, Rome (IT); Rodolfo Ravanelli, Rome (IT); Paolo Campana, Rome (IT)

(73) Assignee: Thales Alenia Space Italia S.p.A. Con Unico Socio, Rome (IT)

( * ) Notice: Subject to any disclaimer, the term of this patent is extended or adjusted under 35 U.S.C. 154(b) by 92 days.

(21) Appl. No.: 16/062,966

(22) PCT Filed: Dec. 19, 2016

(86) PCT No.: PCT/EP2016/081811
§ 371 (c)(1),
(2) Date: Jun. 15, 2018

(87) PCT Pub. No.: WO2017/103286
PCT Pub. Date: Jun. 22, 2017

(65) Prior Publication Data

US 2019/0006770 A1 Jan. 3, 2019

(30) Foreign Application Priority Data

Dec. 18, 2015 (EP) ..... 15425110

(51) Int. Cl.
*H01Q 19/19* (2006.01)
*H01Q 1/28* (2006.01)
(Continued)

(52) U.S. Cl.
CPC ..... *H01Q 19/193* (2013.01); *H01Q 1/288* (2013.01); *H01Q 5/47* (2015.01); *H01Q 21/0037* (2013.01);
(Continued)

(58) Field of Classification Search
CPC ..... H01Q 21/00; H01Q 21/28; H01Q 21/29; H01Q 21/30; H01Q 25/002; H01Q 25/004; H01Q 25/00
(Continued)

(56) References Cited

U.S. PATENT DOCUMENTS

2005/0099350 A1* 5/2005 Gothard ..... H01Q 19/193 343/781 CA
2009/0231208 A1* 9/2009 Egawa ..... H01Q 1/242 343/702
(Continued)

FOREIGN PATENT DOCUMENTS

WO WO 99/10950 3/1999

OTHER PUBLICATIONS

PCT International Search Report and Written Opinion for PCT/EP2016/081811 dated Feb. 16, 2017.

*Primary Examiner* — Binh B Tran
(74) *Attorney, Agent, or Firm* — McCarter & English, LLP

(57) ABSTRACT

Disclosed herein is a double-reflector antenna (1) for use on board a satellite or space platform for data downlink or for telemetry, tracking and command. Said double-reflector antenna (1) comprises a main reflector (11) and a sub-reflector (12) arranged coaxially with, and in front of, one another. Additionally, the double-reflector antenna (1) further comprises a coaxial feeder, that is arranged coaxially with the main reflector (11) and the sub-reflector (12), and that includes inner (14) and outer (13) conductors arranged
(Continued)

coaxially with, and spaced apart from, one another. The coaxial feeder is designed to be fed with downlink microwave signals to be transmitted by the double-reflector antenna (1), and to radiate said downlink microwave signals through a feed aperture (15), that is located centrally with respect to the main reflector (11) and that gives onto the sub-reflector (12). The inner conductor (14) protrudes axially and outwardly from the feed aperture (15) up to the sub-reflector (12) and is rigidly coupled to said sub-reflector (12) thereby supporting said sub-reflector (12).

22 Claims, 5 Drawing Sheets

(51) Int. Cl.

| | |
|---|---|
| ***H01Q 5/47*** | (2015.01) |
| ***H01Q 21/00*** | (2006.01) |
| ***H01Q 25/00*** | (2006.01) |
| *H01Q 21/28* | (2006.01) |
| *H01Q 21/29* | (2006.01) |
| *H01Q 1/36* | (2006.01) |
| *H01Q 9/04* | (2006.01) |

(52) U.S. Cl.
CPC ..... *H01Q 25/001* (2013.01); *H01Q 1/36* (2013.01); *H01Q 9/045* (2013.01); *H01Q 21/00* (2013.01); *H01Q 21/28* (2013.01); *H01Q 21/29* (2013.01); *H01Q 25/00* (2013.01); *H01Q 25/002* (2013.01); *H01Q 25/004* (2013.01)

(58) Field of Classification Search
USPC .... 343/724, 725, 729, 730, 751, 755, 781 P, 343/853, 879, 893
See application file for complete search history.

(56) References Cited

U.S. PATENT DOCUMENTS

2015/0280328 A1* 10/2015 Sanford ..... H01Q 1/06 343/786
2015/0340767 A1 11/2015 Smith et al.

* cited by examiner

DOUBLE-REFLECTOR ANTENNA AND RELATED ANTENNA SYSTEM FOR USE ON BOARD LOW-EARTH-ORBIT SATELLITES FOR HIGH-THROUGHPUT DATA DOWNLINK AND/OR FOR TELEMETRY, TRACKING AND COMMAND

CROSS-REFERENCE TO RELATED APPLICATIONS

This application is a 35 U.S.C. § 371 National Stage filing of International Application No. PCT/EP2016/081811, filed on Dec. 19, 2016, which claims priority to European Patent Application 15425110.2, filed on Dec. 18, 2015.

TECHNICAL FIELD OF THE INVENTION

The present invention concerns, in general, a double-reflector antenna and a related antenna system for use on board a satellite or space platform for data downlink (DDL) and/or for Telemetry, Tracking and Command (TT&C).

In particular, the present invention relates to a double-reflector antenna for use on board low-Earth-orbit (LEO) satellites for high-throughput DDL or for TT&C, and to an integrated antenna system for both DDL and TT&C.

BACKGROUND ART

Typically, low-Earth-orbit (LEO) satellites orbit at a height from the Earth that varies approximatively between 400 and 800 km, are generally equipped with Earth observation systems, such as synthetic aperture radars (SARs) and/or optical instruments, and are configured to transmit remotely-sensed data to ground stations by means of microwave antennas. The transmission from LEO satellites to ground stations of data remotely sensed by on-board Earth observation systems is generally referred to as data downlink (DDL) and antennas used for this function are generally known as DDL antennas.

Moreover, special ground stations, typically called Telemetry, Tracking and Control (TT&C) stations, are used to monitor and control operation of LEO satellites. In general terms, TT&C stations receive telemetry data from LEO satellites to monitor operation thereof, and transmit commands to LEO satellites to control operation thereof and ranging signals to track said satellites. Therefore, LEO satellites need to be equipped also with TT&C antennas for TT&C data exchange.

As is known, current LEO satellites are equipped with two separate antennas for DDL and TT&C, respectively. This fact causes installation problems, especially on board LEO satellites fitted with large antennas and/or appendages (such as solar arrays, booms, supports, instruments, etc.), since both DDL and TT&C antennas require a very large field of view.

Nowadays, all European LEO satellites for Earth observation use S and X bands almost exclusively for TT&C and DDL (as broadly known, the S band being defined as the microwave portion of the electromagnetic spectrum including frequencies ranging from 2 to 4 GHz, while the X band being defined as the microwave portion of the electromagnetic spectrum including frequencies ranging approximatively from 7 to 12 GHz), but these bands are becoming more and more congested due to their the massive use. For this reason, a portion of K band (as broadly known, the K band being defined as the microwave portion of the electromagnetic spectrum including frequencies ranging from 18 to 27 GHz) has been recently allocated for DDL in order to increase downlink throughput capability of LEO satellites, wherein said new K-band portion allocated for DDL includes frequencies ranging from 25.5 to 27 GHz.

Additionally, a new X-band frequency allocation has been proposed for TT&C by the International Telecommunication Union (ITU) at the World Radiocommunication Conference 2015 (WRC-15) in relation to the Earth Exploration Satellite Service (EESS), including the frequency range 7190-7250 MHz for the TT&C uplink. This new uplink allocation can be used in combination with the existing EESS allocation of the frequency range 8025-8400 MHz for the TT&C downlink.

As is known, current TT&C antennas operating in S or X band are usually based on helix-type antennas or biconical antennas, while current solutions for fixed DDL in X band from LEO satellites mainly employ helices or parasitic coaxial horns. In this connection, it is worth noting that wire-type antennas (i.e., helices or wire-based solutions) are not applicable to the new K-band portion allocated for DDL due to technological problems and limited power handling capability (in particular, due to thermal problems and corona discharge). Moreover, parasitic-coaxial-horn-type solutions for DDL are currently limited by a low level of cross-polarization discrimination, well above the acceptable level for dual-polarization frequency reuse (i.e., higher than 20 dB cross-polarization discrimination).

OBJECT AND SUMMARY OF THE INVENTION

A general object of the present invention is that of providing an innovative antenna technology for use on board a satellite or a space platform for DDL and/or TT&C.

More in particular, a first specific object of the present invention is that of providing an innovative antenna for use on board satellites or space platforms, in particular on board LEO satellites, for DDL or for TT&C.

Moreover, a second specific object of the present invention is that of providing a single antenna system integrating both a DDL antenna and a TT&C antenna, such that to limit encumbrance on board satellites and space platforms, in particular on board LEO satellites.

These and other objects are achieved by the present invention in that it relates to a double-reflector antenna and an antenna system, as defined in the appended claims.

In particular, the present invention relates to a double-reflector antenna for use on board a satellite or space platform for DDL or for TT&C, comprising a main reflector and a sub-reflector arranged coaxially with, and in front of, one another. The double-reflector antenna further comprises a coaxial feeder, that is arranged coaxially with the main reflector and the sub-reflector, and that includes inner and outer conductors arranged coaxially with, and spaced apart from, one another. The coaxial feeder is designed to be fed with downlink microwave signals to be transmitted by the double-reflector antenna, and to radiate said downlink microwave signals through a feed aperture, that is located centrally with respect to the main reflector and that gives onto the sub-reflector. The inner conductor protrudes axially and outwardly from the feed aperture up to the sub-reflector and is rigidly coupled to said sub-reflector thereby supporting said sub-reflector.

Moreover, the present invention relates also to an antenna system for use on board a satellite or space platform for DDL and for TT&C, comprising a first antenna and a second antenna, wherein said second antenna is coaxially aligned with, and is arranged on top of, the first antenna. Said first antenna is a first double-reflector antenna comprising a first main reflector and a first sub-reflector arranged coaxially with, and in front of, one another. Said first antenna further comprises a first coaxial feeder, that is arranged coaxially with the first main reflector, the first sub-reflector and the second antenna, and that includes an outer conductor and a first inner conductor which are arranged coaxially with, and spaced apart from, one another. The first coaxial feeder is designed to be fed with first downlink microwave signals to be transmitted by the first antenna, and to radiate said first downlink microwave signals through a first feed aperture, that is located centrally with respect to the first main reflector and that gives onto the first sub-reflector. The first inner conductor protrudes coaxially and outwardly from the first feed aperture up to the first sub-reflector and is rigidly coupled to said first sub-reflector thereby supporting said first sub-reflector. A transmission line is provided in the first inner conductor to feed the second antenna with second downlink microwave signals to be transmitted by said second antenna.

BRIEF DESCRIPTION OF THE DRAWINGS

For a better understanding of the present invention, preferred embodiments, which are intended purely as non-limiting examples, will now be described with reference to the attached drawings (not to scale), where.

DETAILED DESCRIPTION OF PREFERRED EMBODIMENTS OF THE INVENTION

The following discussion is presented to enable a person skilled in the art to make and use the invention. Various modifications to the embodiments will be readily apparent to those skilled in the art, without departing from the scope of the present invention as claimed. Thence, the present invention is not intended to be limited to the embodiments shown and described, but is to be accorded the widest scope consistent with the principles and features disclosed herein and defined in the appended claims.

A first aspect of the present invention concerns a double-reflector antenna designed to be installed on board satellites and space platforms, in particular LEO satellites, for DDL in the X or K band or for TT&C in the X band.

Figure 1:
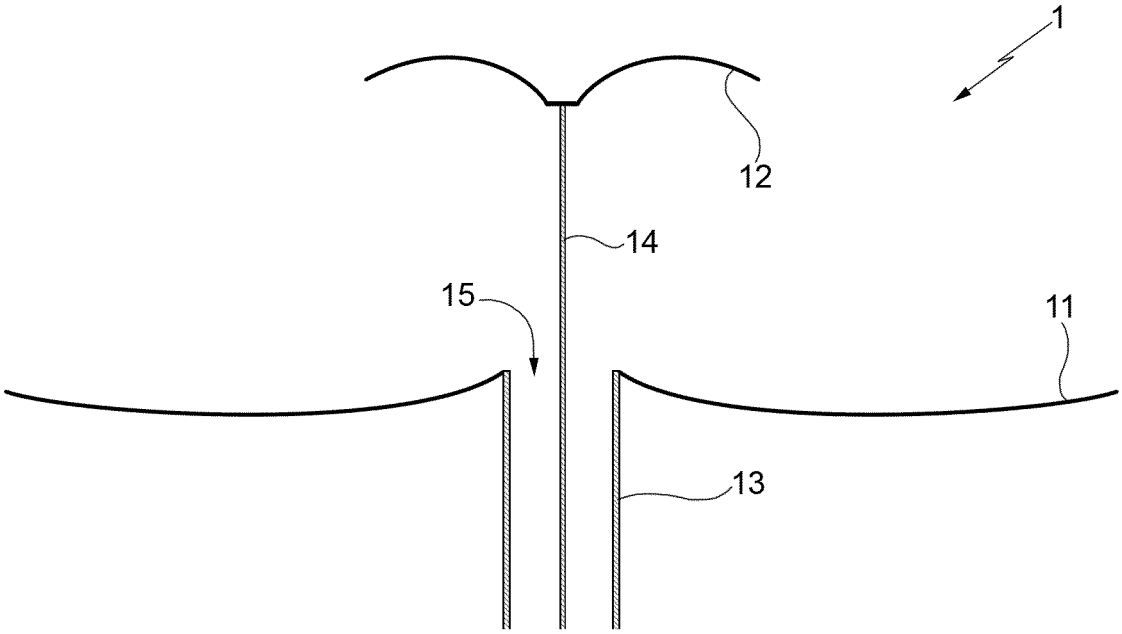
FIG. 1 schematically illustrates a double-reflector antenna for use on board LEO satellites for DDL or TT&C according to an embodiment of a first aspect of the present invention.

In this connection reference is made to FIG. 1, that shows a schematic cross-sectional view of a double-reflector antenna (denoted as a whole by 1) for use on board LEO satellites for DDL or TTC according to an embodiment of said first aspect of the present invention.

The double-reflector antenna 1 is designed to operate in the X or K band and comprises a main reflector 11 and a sub-reflector 12, that are arranged coaxially with, and in front of, one another, and that are shaped (i.e., profiled) to provide, in use, a predefined DDL or TT&C coverage with respect to Earth's surface.

Conveniently, the main reflector 11 and the sub-reflector 12 are centred on, and have, each, a respective rotational symmetry with respect to, one and the same axis of symmetry.

The double-reflector antenna 1 further comprises a coaxial feeder, that is arranged coaxially with the main reflector 11 and the sub-reflector 12 and that includes an outer conductor 13 and an inner conductor 14 (in particular, outer and inner microwave conductors 13 and 14).

Said outer conductor 13 is internally hollow and ends with a feed aperture 15, that is located centrally with respect to the main reflector 11 and gives onto the sub-reflector 12 (i.e., is arranged in front of said sub-reflector 12). Conveniently, the outer conductor 13 has a tubular (or cylindrical) shape, and the feed aperture 15 is a circular aperture.

The inner conductor 14 axially extends inside the outer conductor 13 and is spaced apart from said outer conductor 13, wherein an air gap is present between said outer and inner conductors 13 and 14. Moreover, said inner conductor 14 protrudes axially, outwardly and orthogonally from the feed aperture 15 up to a central portion of the sub-reflector 12, and is rigidly coupled/connected to said central portion of the sub-reflector 12, thereby supporting said sub-reflector 12.

Conveniently, the inner conductor 14 may be a rigid, cylindrically-shaped, metal structure coupled/connected rigidly and electrically to, and rigidly supporting, the sub-reflector 12.

Preferably, the coaxial feeder is a circular coaxial waveguide.

More preferably, the coaxial feeder is a circular coaxial waveguide designed to be fed with, to allow propagation of, and to radiate two quadrature coaxial modes. More preferably, said two quadrature coaxial modes are TEllx and TElly modes.

The architecture of the double-reflector antenna 1 has several substantial improvements with respect to other known antenna systems based on double-reflecting-surface optics, such as the solution known in the literature as "Axial Displaced Ellipse" (ADE) (in this respect, reference may, for example, be made to J. R. Bergmann, F. J. S. Moreira, *An omnidirectional ADE reflector antenna*, Microwave and Optical Technology Letters, Vol. 40, Issue 3, February 2004).

In particular, the differences between the double-reflector antenna 1 and a typical ADE antenna are:

- the inner conductor 14 is axially prolonged from the feed aperture 15 to rigidly sustain the sub-reflector and, hence, with no need for radome or struts for supporting said sub-reflector 12;
- the sub-reflector 12 is self-grounded due to the electrical connection with the inner conductor 14, thereby avoiding any electrostatic discharge (ESD) problem;
- the distance between the main reflector 11 and the sub-reflector 12 is preferably less than one wavelength, leading to a strong electromagnetic coupled assembly (providing a design not based on geometrical optics);
- conveniently, the reflecting surfaces of the main reflector 11 and the sub-reflector 12 are modulated (corrugated and/or shaped) surfaces and, hence, are not analytic surfaces as according to ADE design;

preferably, the direct, coaxial feeding of the double-reflector antenna 1 is based on two coaxial modes in quadrature (i.e., TEllx and TElly) and not on differential modes (TEM or TM01/TE01), thereby obtaining low cross-polarization levels and making antenna manufacturing easier.

Additionally, a second aspect of the present invention concerns an integrated antenna system for use on board satellites and space platforms, in particular LEO satellites, which integrated antenna system includes two antennas arranged on top of one another, one for DDL and the other for TT&C; wherein the lower antenna is a double-reflector antenna designed according to the first aspect of the present invention; wherein a transmission line (such as a circular/square/rectangular coaxial waveguide, or a coaxial cable, or a circular/square/rectangular waveguide) is provided (i.e., arranged or formed) in the inner conductor of the coaxial feeder of the lower double-reflector antenna to feed the upper antenna; and wherein the lower and upper antennas are coaxially aligned to obtain a very compact configuration.

Therefore, the second aspect of the present invention teaches to integrates a DDL antenna and a TT&C antenna into a single antenna system, thereby allowing to co-locate both said antennas on board LEO satellites and, hence, providing a solution that is particularly advantageous in those scenarios where space on board LEO satellites is strongly limited by the presence of other antennas/appendages.

Figure 2:
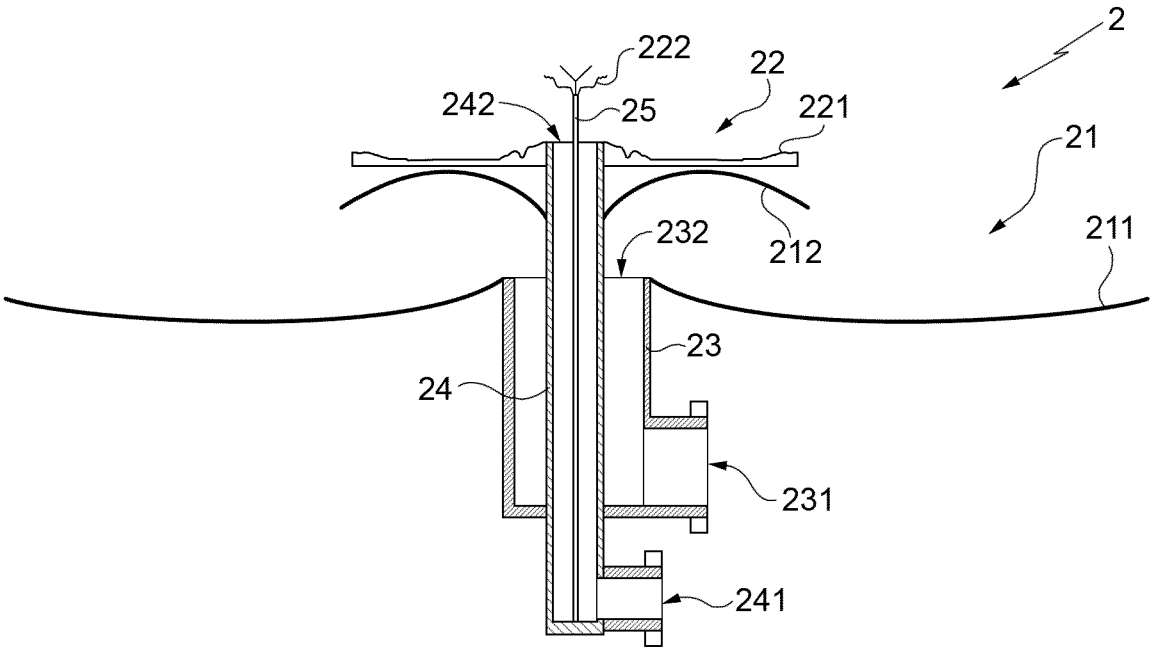
FIGS. 2-4 show a first integrated antenna system for use on board LEO satellites for both DDL and TT&C according to a first preferred embodiment of a second aspect of the present invention.
Figure 3:
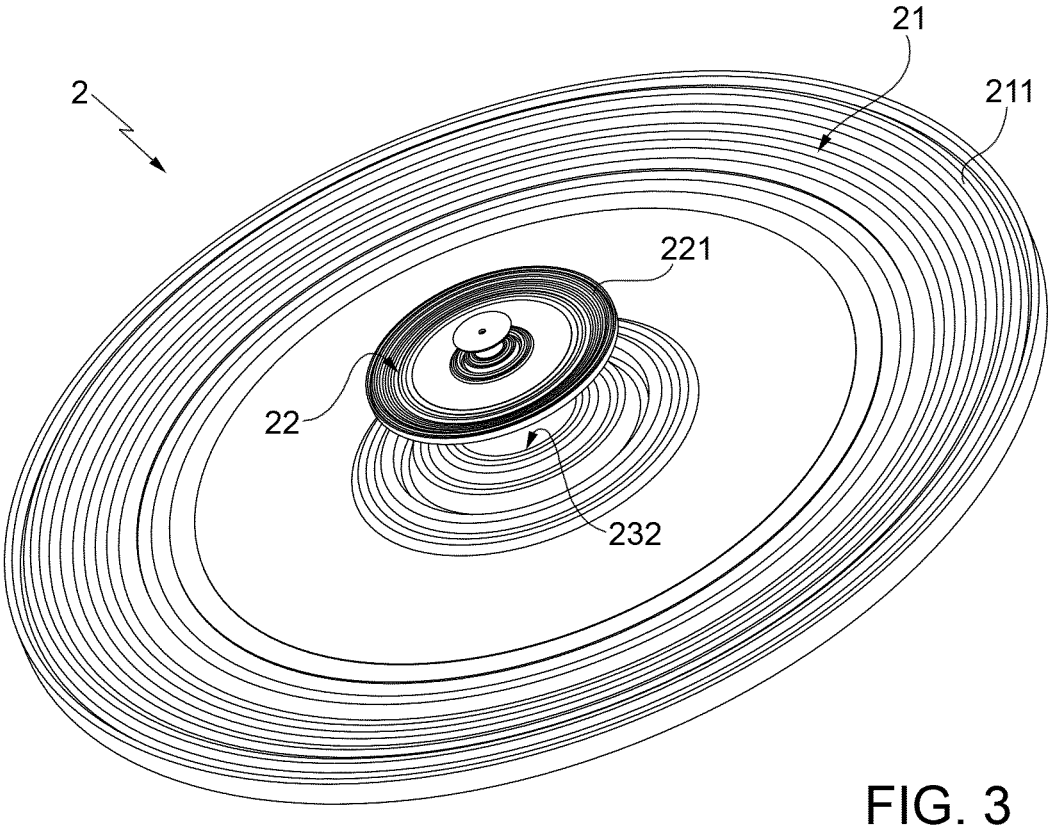
Figure 4:
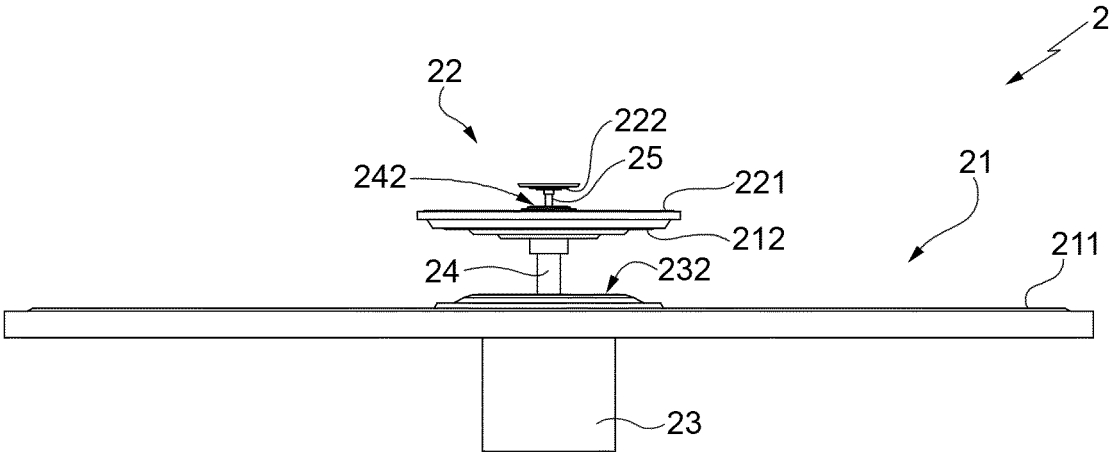

For a better understanding of the second aspect of the present invention, FIGS. 2, 3 and 4 show a first integrated antenna system (denoted as a whole by 2) for use on board LEO satellites for both DDL and TTC according to a first preferred embodiment of said second aspect of the present invention. In particular, FIG. 2 is a schematic cross-sectional view of said first integrated antenna system 2, while FIGS. 3 and 4 are perspective and lateral views thereof.

In detail, the first integrated antenna system 2 includes a TT&C antenna 21 and a DDL antenna 22, wherein said DDL antenna 22 is arranged on top of, and is coaxially aligned with, said TT&C antenna 21.

The TT&C and DDL antennas 21 and 22 are double-reflector antennas designed to operate, respectively, in the X band and in the K band.

In particular, the TT&C antenna 21 comprises a first main reflector 211 and a first sub-reflector 212, that are arranged coaxially with, and in front of, one another, and that are shaped (i.e., profiled) to provide, in use, a predefined TT&C coverage with respect to Earth's surface.

The DDL antenna 22 comprises a second main reflector 221 and a second sub-reflector 222, that are arranged coaxially with, and in front of, one another, and that are shaped (i.e., profiled) to provide, in use, a predefined DDL coverage with respect to Earth's surface.

The first main reflector and sub-reflector 211,212 and the second main reflector and sub-reflector 221,222 are arranged coaxially with one another, wherein the second main reflector 221 is located on top of (i.e., over) a backside of the first sub-reflector 212.

Conveniently, the first main reflector and sub-reflector 211,212 and the second main reflector and sub-reflector 221,222 are centred on, and have, each, a respective rotational symmetry with respect to, one and the same axis of symmetry.

Conveniently, the footprint of the (upper) DDL antenna 22 does not exceed the size of the first sub-reflector 212 thereby resulting in the (lower) TT&C antenna 21 having a wide, blockage-free field of view for TT&C.

Conveniently, the first sub-reflector 212 may be made as a first reflecting surface formed on a bottom portion of a disc-shaped interface structure coaxial with the TT&C and DDL antennas 21 and 22, and the second main reflector 221 may be made as a second reflecting surface formed on a top portion of said disc-shaped interface structure, wherein said top portion is located on or over said bottom portion of said disc-shaped interface structure, and wherein said top and bottom portions of said disc-shaped interface structure give onto (i.e., are located in front of) the second sub-reflector 222 and the first main reflector 211, respectively.

Preferably, the first main reflector 211 and the first sub-reflector 212 are profiled for an X-band TT&C antenna pattern (up to 95° half angle) over the enlarged ITU frequency spectrum 7.19-8.4 GHz, while the DDL antenna 22 is designed to provide a DDL wide-coverage isoflux pattern in the K band at low cross-polarization within a field of view of +/−63°, which is typical for a satellite orbiting at 600 Km from the Earth.

The first integrated antenna system 2 further comprises an outer conductor 23, an intermediate conductor 24 and an inner conductor 25 (in particular, outer, intermediate and inner microwave conductors 23,24,25).

The outer conductor 23 is internally hollow, is designed to be internally fed, through a TT&C input/output port 231, with X-band TT&C downlink signals to be transmitted by the TT&C antenna 21, and ends with a TT&C feed aperture 232, that is located centrally with respect to the first main reflector 211 and gives onto the first sub-reflector 212 (i.e., is arranged in front of said first sub-reflector 212), wherein said TT&C input/output port 231 and said TT&C feed aperture 232 are located, respectively, at a first end and at a second end of said outer conductor 23.

Conveniently, the outer conductor 23 has a tubular (or cylindrical) shape, and the TT&C feed aperture 232 is a circular aperture.

The intermediate conductor 24 is a rigid, internally hollow structure, is designed to be internally fed, through a DDL input port 241, with K-band DDL signals to be transmitted by the DDL antenna 22, and includes:

a lower portion that coaxially extends (at least in part) inside the outer conductor 23 up to the TT&C feed aperture 232 and that is spaced apart from said outer conductor 23, wherein a first air gap is present between said outer conductor 23 and said lower portion of the intermediate conductor 24; and an upper portion that protrudes coaxially, outwardly and orthogonally from the TT&C feed aperture 232 up to a central portion of the first sub-reflector 212, is rigidly coupled/connected to said central portion of the first sub-reflector 212 thereby supporting said first sub-reflector 212, and extends also over said first sub-reflector 212 up to the second main reflector 221, ending with a DDL feed aperture 242, that is located centrally with respect to the second main reflector 221 and gives onto the second sub-reflector 222 (i.e., is arranged in front of said second sub-reflector 222).

The DDL input port 241 and the DDL feed aperture 242 are located, respectively, at a first end and at a second end of the intermediate conductor 24.

Conveniently, also the intermediate conductor 24 has a tubular (or cylindrical) shape, and the DDL feed aperture 242 is a circular aperture.

The inner conductor 25 is a rigid structure and includes:

a lower portion that axially extends inside the intermediate conductor 24 up to the DDL feed aperture 242 and that is spaced apart from said intermediate conductor 24, wherein a second air gap is present between said intermediate conductor 24 and said lower portion of the inner conductor 25; and an upper portion that protrudes axially, outwardly and orthogonally from the DDL feed aperture 242 up to a central portion of the second sub-reflector 222, and is rigidly coupled/connected to said central portion of the second sub-reflector 222 thereby supporting said second sub-reflector 222.

Conveniently, the inner conductor 25 may be a rigid, cylindrically-shaped, metal structure coupled/connected rigidly and electrically to, and rigidly supporting, the second sub-reflector 222.

The outer conductor 23, the lower portion of the intermediate conductor 24 and the first air gap define (or form) a first coaxial feeder (preferably, a circular coaxial waveguide) designed to allow:

the X-band TT&C downlink signals to propagate from the TT&C input/output port 231 up to the TT&C feed aperture 232; and X-band TT&C uplink signals received by the TT&C antenna 21 to propagate from said TT&C feed aperture 232 to said TT&C input/output port 231.

The intermediate conductor 24, the lower portion of the inner conductor 25 and the second air gap define (or form) a second coaxial feeder (preferably, a circular coaxial waveguide) designed to allow the K-band DDL signals to propagate from the DDL input port 241 up to the DDL feed aperture 242.

Preferably, the second coaxial feeder is a circular coaxial waveguide designed to be fed with, to allow propagation of, and to radiate two quadrature coaxial modes. More preferably, said two quadrature coaxial modes are TEllx and TElly modes.

The main technical advantages of the first integrated antenna system 2 over a typical ADE antenna are:

the coaxial integration of the upper double-reflector DDL antenna 22 on top of the lower double-reflector TT&C antenna 21, wherein the outer conductor 23 is used to coaxially feed the lower double-reflector TT&C antenna 21, the intermediate conductor 24 is used to rigidly support the first sub-reflector 212 (thence, with no need for radome or struts) and to coaxially feed the upper double-reflector DDL antenna 22, and the inner conductor 25 is used to rigidly support the second sub-reflector 222 (thence, again with no need for radome or struts);

the first and second sub-reflectors 212 and 222 are self-grounded due to the electrical connection with the intermediate and inner conductors 24 and 25, respectively, thereby avoiding any electrostatic discharge (ESD) problem;

the distance between the first main reflector 211 and the first sub-reflector 212 and the distance between the second main reflector 221 and the second sub-reflector 222 are preferably less than one wavelength, leading to two strong electromagnetic coupled assemblies (providing a design not based on geometrical optics);

conveniently, the reflecting surfaces of the first and second main reflectors 211 and 221 and of the first and second sub-reflectors 212 and 222 are modulated (corrugated and/or shaped) surfaces and, hence, are not analytic surfaces as according to ADE design;

preferably, the direct, coaxial feeding of the upper double-reflector DDL antenna 22 is based on two quadrature coaxial modes (i.e., TEllx and TElly) and not on differential modes (TEM or TM01/TE01), thereby obtaining low cross-polarization levels and making antenna manufacturing easier.

Figure 5:
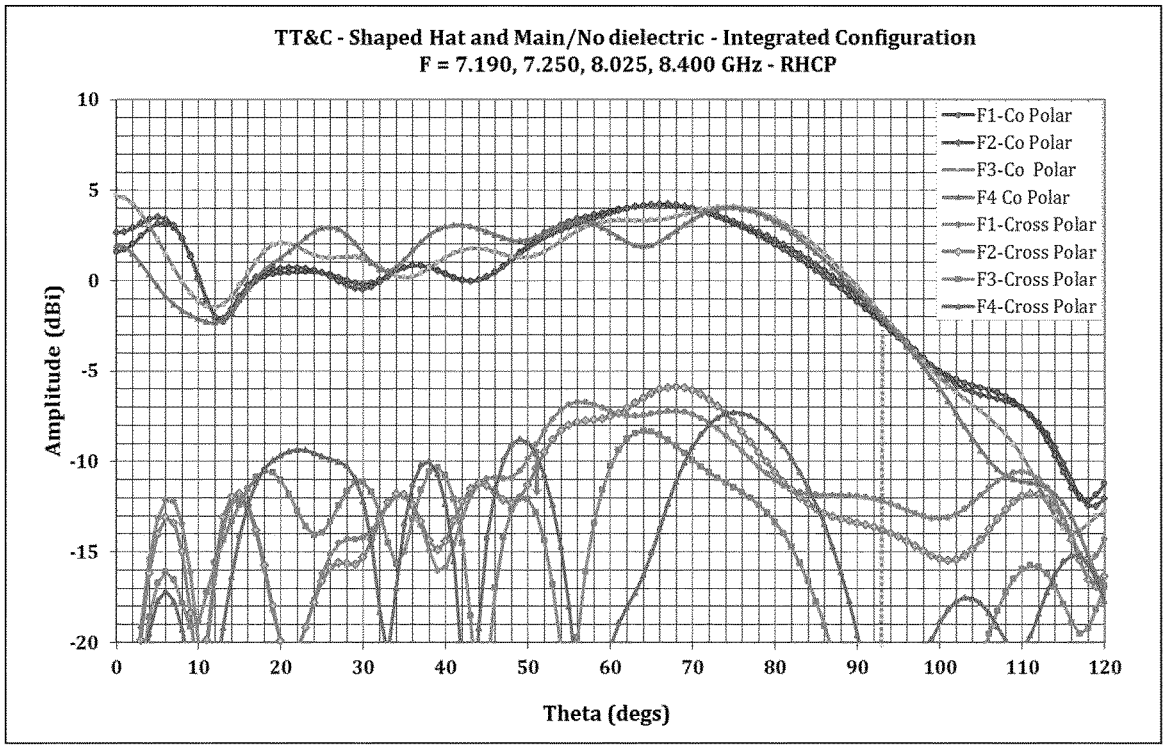
FIGS. 5 and 6 show radiation patterns related to the first integrated antenna system shown in FIGS. 2-4.
Figure 6:
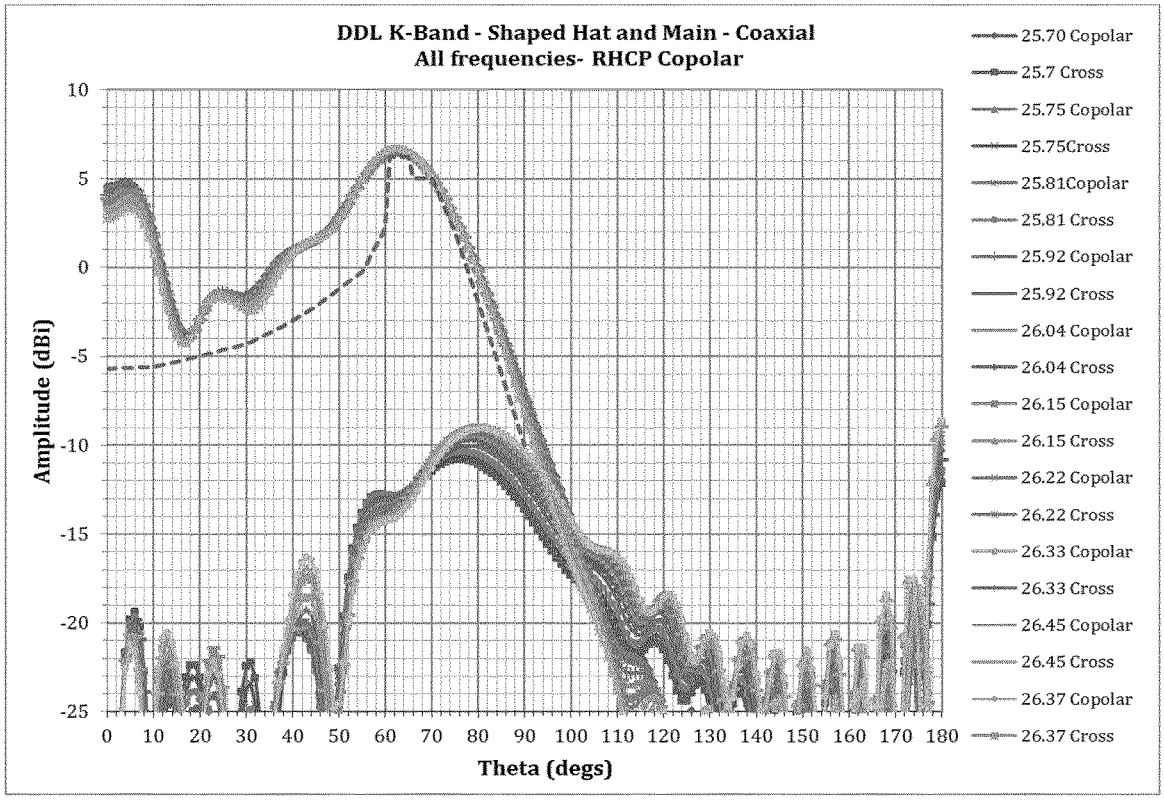

FIGS. 5 and 6 show radiation patterns related to the first integrated antenna system 2. In particular, FIG. 5 shows co-polarization and cross-polarization radiation patterns of the lower X-band double-reflector TT&C antenna 21 in the TT&C uplink 7190-7250 MHz frequency range and in the TT&C downlink 8025-8400 MHz frequency range, while FIG. 6 shows co-polarization and cross-polarization radiation patterns of the upper K-band double-reflector DDL antenna 22 in the DDL 25.5-27.0 GHz frequency range.

As shown in FIG. 6, the DDL antenna 22 exhibits a high figure of cross-polarization discrimination, thereby allowing polarization reuse.

The TT&C and DDL double-reflector antennas 21 and 22 have a similar design and can be considered as a new, innovative evolution of the parasitic coaxial horn described in R. Ravanelli et al. "*Multi-Objective Optimization of XBA Sentinel Antenna*", Proceedings of the 5th European Conference on Antennas and Propagation (EUCAP), Rome, 1-15 Apr. 2011.

In fact, differently from the solution according to "*Multi-Objective Optimization of XBA Sentinel Antenna*", the TT&C and DDL double-reflector antennas 21 and 22 are characterized by the feeding and subreflector-support coaxial architecture previously described in detail.

Moreover, the TT&C double-reflector antenna 21 (in particular, the first main reflector 211 and sub-reflector 212) and the DDL double-reflector antenna 22 (in particular, the second main reflector 221 and sub-reflector 222) are numerically profiled to provide, each, the desired gain over coverage, wherein the upper DDL double-reflector antenna 22 provides also high cross-polarization discrimination, has low losses and provides no blockage to the lower TT&C double-reflector antenna 21, with negligible back-coupling towards the first main reflector 211.

According to an alternative embodiment, a radome can be conveniently used, in place of the inner conductor 25, to support the second sub-reflector 222. In this case, the DDL antenna 22 is fed through a larger circular waveguide aperture above cut-off excited by two TEllx and TElly fundamental circular waveguide modes in quadrature.

Figure 7:
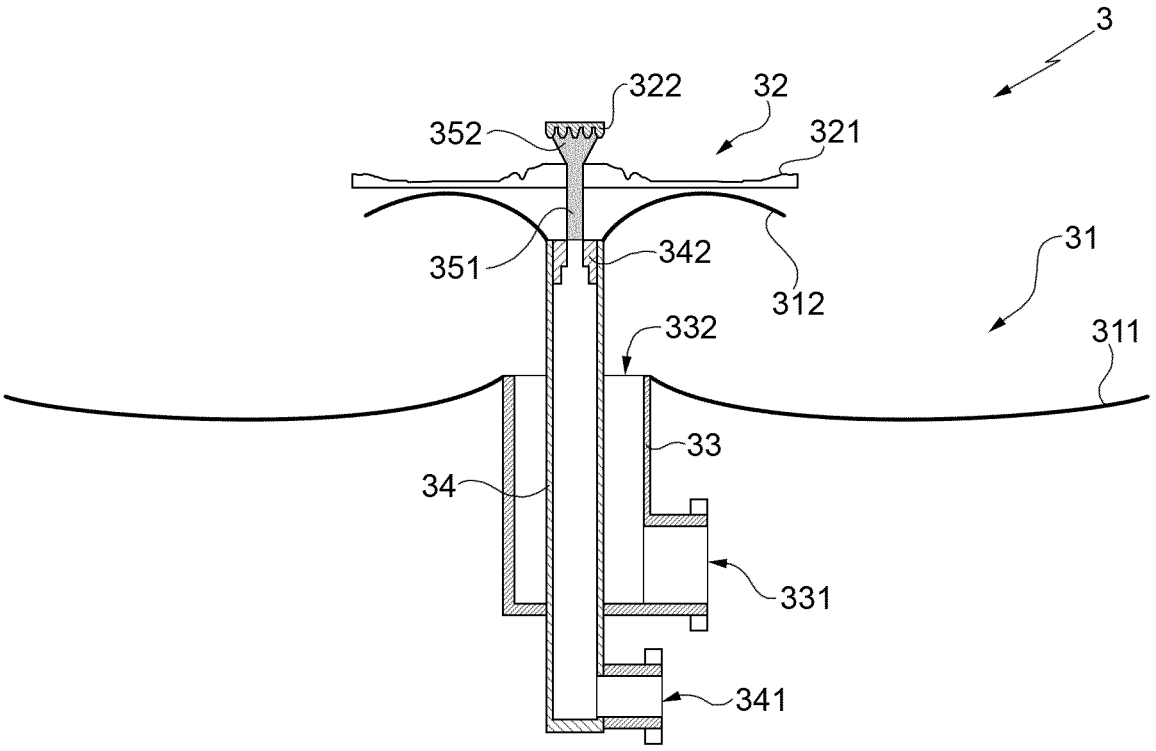
FIGS. 7 and 8 show a second integrated antenna system for use on board LEO satellites for both DDL and TT&C according to a second preferred embodiment of the second aspect of the present invention.
Figure 8:
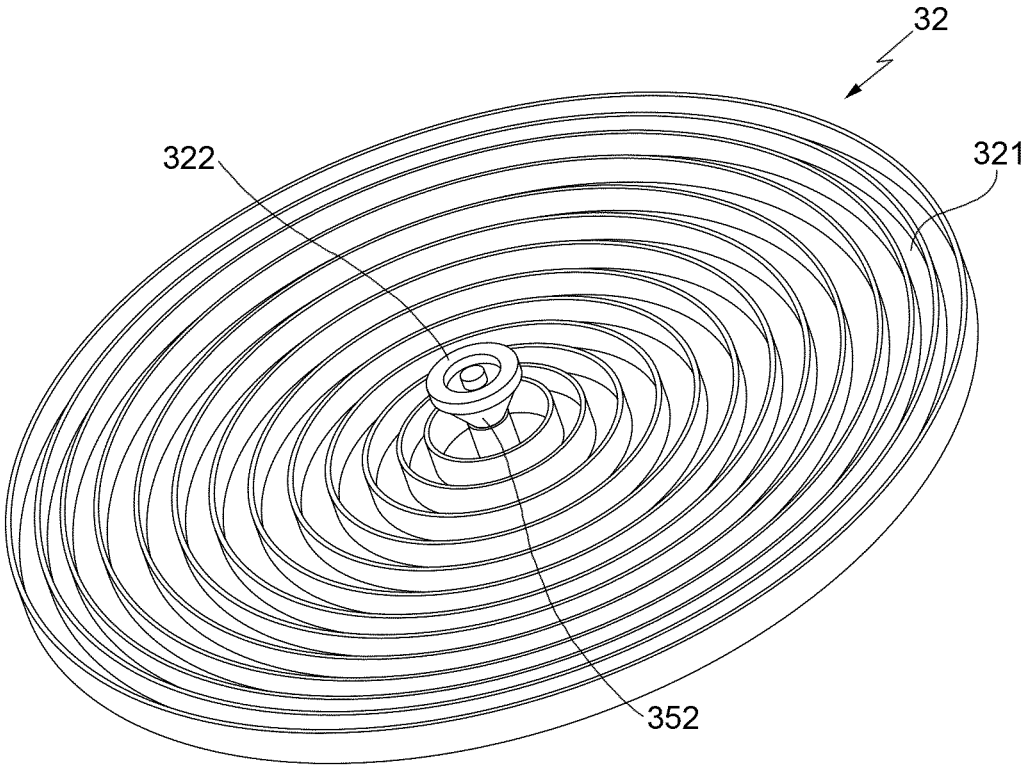

FIGS. 7 and 8 show a second integrated antenna system (denoted as a whole by 3) for use on board LEO satellites for both DDL and TTC according to a second preferred embodiment of said second aspect of the present invention. In particular, FIG. 7 is a schematic cross-sectional view of said second integrated antenna system 3, while FIG. 8 is a perspective view of an upper antenna of said second integrated antenna system 3.

In detail, the second integrated antenna system 3 includes a TT&C antenna 31 and a DDL antenna 32, wherein said DDL antenna 32 is arranged on top of, and is coaxially aligned with, said TT&C antenna 31.

The TT&C and DDL antennas 31 and 32 are double-reflector antennas designed to operate, respectively, in the X band and in the K band.

In particular, the TT&C antenna 31 comprises a first main reflector 311 and a first sub-reflector 312, that are arranged coaxially with, and in front of, one another, and that are shaped (i.e., profiled) to provide, in use, a predefined TT&C coverage with respect to Earth's surface.

The DDL antenna 32 comprises a second main reflector 321 and a second sub-reflector 322, that are arranged coaxially with, and in front of, one another, and that are shaped (i.e., profiled) to provide, in use, a predefined DDL coverage with respect to Earth's surface.

The first main reflector and sub-reflector 311,312 and the second main reflector and sub-reflector 321,322 are arranged coaxially with one another, wherein the second main reflector 321 is located on top of (i.e., over) a backside of the first sub-reflector 312.

Conveniently, the first main reflector and sub-reflector 311,312 and the second main reflector and sub-reflector 321,322 are centred on, and have, each, a respective rotational symmetry with respect to, one and the same axis of symmetry.

Conveniently, the footprint of the (upper) DDL antenna 32 does not exceed the size of the first sub-reflector 312 thereby resulting in the (lower) TT&C antenna 31 having a wide, blockage-free field of view for TT&C.

Conveniently, the first sub-reflector 312 may be made as a first reflecting surface formed on a bottom portion of a disc-shaped interface structure coaxial with the TT&C and DDL antennas 31 and 32, and the second main reflector 321 may be made as a second reflecting surface formed on a top portion of said disc-shaped interface structure, wherein said top portion is located on or over said bottom portion of said disc-shaped interface structure, and wherein said top and bottom portions of said disc-shaped interface structure give onto (i.e., are located in front of) the second sub-reflector 322 and the first main reflector 311, respectively.

The second integrated antenna system 3 further comprises an outer conductor 33 and an inner conductor 34 (in particular, outer and inner microwave conductors 33,34).

The outer conductor 33 is internally hollow, is designed to be internally fed, through a TT&C input/output port 331, with X-band TT&C downlink signals to be transmitted by the TT&C antenna 31, and ends with a TT&C feed aperture 332, that is located centrally with respect to the first main reflector 311 and gives onto the first sub-reflector 312 (i.e., is arranged in front of said first sub-reflector 312); wherein said TT&C input/output port 331 and said TT&C feed aperture 332 are located, respectively, at a first end and at a second end of said outer conductor 33.

Conveniently, the outer conductor 33 has a tubular (or cylindrical) shape, and the TT&C feed aperture 332 is a circular aperture.

The inner conductor 34 is a rigid, internally hollow structure, is designed to be internally fed, through a DDL input port 341, with K-band DDL signals to be transmitted by the DDL antenna 32, and includes:

a lower portion that coaxially extends (at least in part) inside the outer conductor 33 up to the TT&C feed aperture 332 and that is spaced apart from said outer conductor 33, wherein an air gap is present between said outer conductor 33 and said lower portion of the inner conductor 34; and an upper portion that protrudes coaxially, outwardly and orthogonally from the TT&C feed aperture 332 up to a central portion of the first sub-reflector 312, and ends with a stepped transition portion 342 that is rigidly coupled/connected to said central portion of the first sub-reflector 312 thereby supporting said first sub-reflector 312.

Conveniently, also the inner conductor 34 has a tubular (or cylindrical) shape.

The first integrated antenna system 3 further comprises a dielectric structure, that includes:

a lower portion 351 axially extending from the stepped transition portion 342 of the inner conductor 34, over the first sub-reflector 312 up to the second main reflector 321; and an upper portion 352 that protrudes coaxially and outwardly from said second main reflector 321 up to the second sub-reflector 322 and that is rigidly coupled/connected to said second sub-reflector 322 thereby supporting the latter.

Preferably, said upper portion 352 of the dielectric structure is cone-shaped and the second sub-reflector 322 is a sputtered metallic sub-reflector (more preferably, a sputtered aluminium sub-reflector) arranged on top of, and supported by, said cone-shaped upper portion 352 of the dielectric structure.

The outer conductor 33, the lower portion of the inner conductor 34 and the air gap therebetween define (or form) a first feeder of coaxial type (preferably, a circular coaxial waveguide) designed to allow:

the X-band TT&C downlink signals to propagate from the TT&C input/output port 331 up to the TT&C feed aperture 332; and X-band TT&C uplink signals received by the TT&C antenna 31 to propagate from said TT&C feed aperture 332 to said TT&C input/output port 331.

The inner conductor 34 and the dielectric structure define (or form) a second feeder designed to allow the K-band DDL signals to propagate from the DDL input port 341 up to the second sub-reflector 322.

Preferably, the inner conductor 34 is a circular waveguide designed to be fed with and to allow propagation of two TEllx and TElly fundamental circular waveguide modes in quadrature.

The second integrated antenna system 3 and also the configuration according to the aforesaid alternative embodiment of the first integrated antenna system 2 employing a radome for supporting the upper DDL sub-reflector 222 allow to reach slightly higher cross-polarization discrimination performance than the first integrated antenna system 2 illustrated in FIGS. 2-4, but require to be ESD-protected and are mechanically less suitable to sustain lateral loads at launch.

Figure 9:
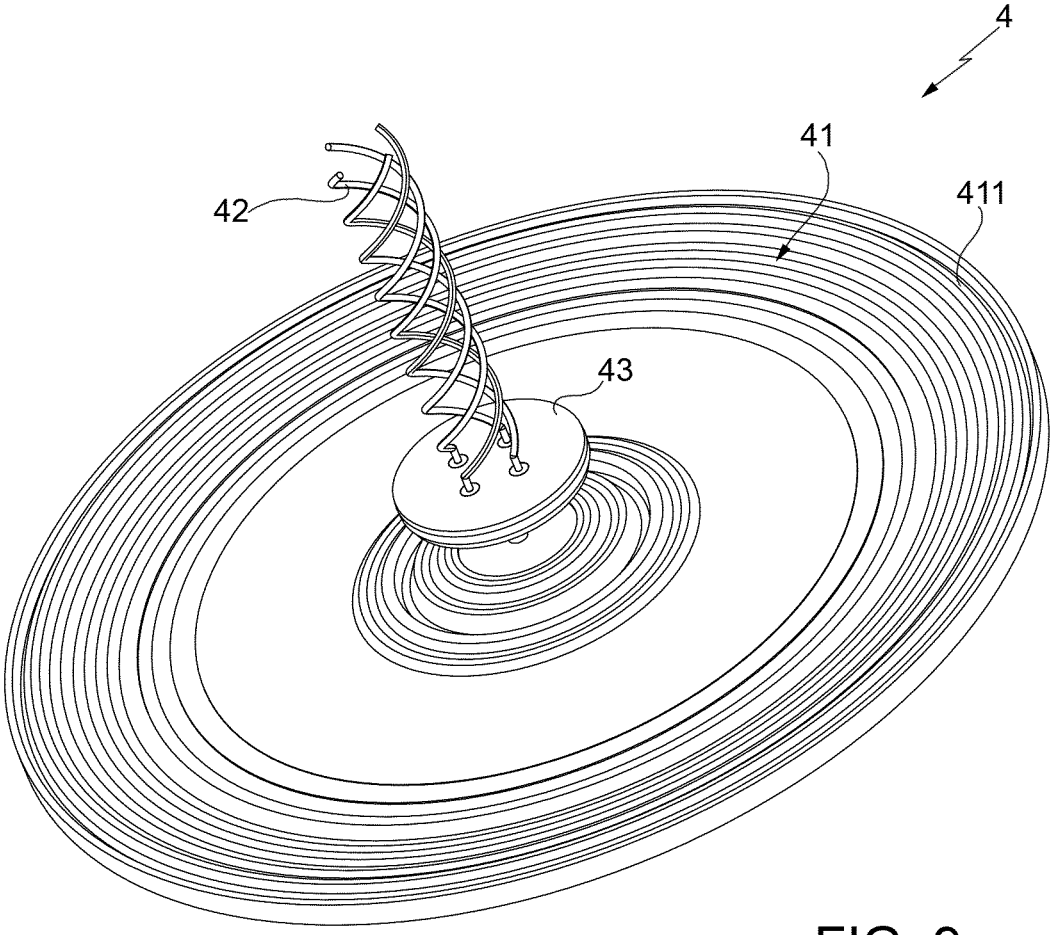
FIG. 9 shows a third integrated antenna system for use on board LEO satellites for both DDL and TT&C according to a third preferred embodiment of the second aspect of the present invention.

FIG. 9 shows a third integrated antenna system (denoted as a whole by 4) for use on board LEO satellites for TT&C and DDL according to a third preferred embodiment of the second aspect of the present invention.

In particular, the third integrated antenna system 4 is compatible with current standard ITU frequency bands allocated for TT&C and DDL services, and includes an X-band DDL double-reflector antenna 41 designed according to the first aspect of the present invention, and an S/X-band TT&C helix antenna 42 (i.e., a helix antenna designed to operate in the S or X band), that is arranged on top of, and coaxially aligned with, said X-band DDL double-reflector antenna 41; wherein the inner conductor of the coaxial feeder (preferably, a circular coaxial waveguide) of said X-band DDL double-reflector antenna 41 is internally hollow, and a radiofrequency (RF) coaxial cable is arranged within said inner conductor to feed the S/X-band TT&C helix antenna 42.

Conveniently, the sub-reflector of the X-band DDL double-reflector antenna 41 is made as a first reflecting surface formed on a bottom portion of a disc-shaped interface structure 43 that is coaxial with said X-band DDL double-reflector antenna 41 and said S/X-band TT&C helix antenna 42, wherein said S/X-band TT&C helix antenna 42 is arranged on a top portion of said disc-shaped interface structure 43 (said top portion being located on or over said bottom portion of the disc-shaped interface structure 43, and said bottom portion and, hence, said sub-reflector giving onto the main reflector 411 of the X-band DDL double-reflector antenna 41).

Again conveniently, the RF coaxial cable axially extends inside the inner conductor of the coaxial feeder of the X-band DDL double-reflector antenna 41 and also over the sub-reflector thereof, through the disc-shaped interface structure 43 up to the S/X-band TT&C helix antenna 42, and is connected to said S/X-band TT&C helix antenna 42 to:

feed said S/X-band TT&C helix antenna 42 with S/X-band TT&C downlink signals to be transmitted; and receive S/X-band TT&C uplink signals received by said S/X-band TT&C helix antenna 42.

Preferably, the main reflector and the sub-reflector of the X-band DDL double-reflector antenna 41 are profiled to provide an isoflux radiation pattern at high cross-polarization discrimination.

For S-band TT&C, also a patch antenna can be conveniently used in place of the helix antenna 42. Instead, for X-band TT&C, a waveguide aperture radiator or a patch antenna can be conveniently used in place of the helix antenna 42.

The advantages of the second aspect of the present invention are immediately clear from the foregoing.

In particular, it is worth remarking that none of the currently known antenna solutions for LEO satellites provide an integrated antenna system that performs a combined DDL and TT&C function with blockage-free DDL and TT&C coverages.

More in detail, an important advantage of the integrated DDL and TT&C antenna system according to the second aspect of the present invention is the minimum reciprocal interference between the two integrated DDL and TT&C antennas, and the easy, single allocation/installation on board a spacecraft/satellite considering the large-coverage fields of view requested for the DDL and TT&C functions (close to hemisphere). In fact, the integrated DDL and TT&C antenna system according to the second aspect of the present invention, by integrating the DDL and TT&C functions into a single antenna assembly, allows to minimize problems of installation and interference on board LEO satellites. In particular, the exploitation of the integrated DDL and TT&C antenna system according to the second aspect of the present invention is particularly advantageous on board small satellites (or small space platforms) fitted with large antennas/appendages which largely limit available fields of view for DDL and TT&C services.

An additional advantage of the integrated DDL and TT&C antenna system according to the second aspect of the present invention is that the DDL antenna design is characterized by high polarization purity, allowing frequency reuse of the spectrum with high data rate transmission to Earth. In particular, the integrated DDL and TT&C antenna system according to the second aspect of the present invention increases transmission capacity of DDL payload via polarization reuse of the allocated microwave spectrum thanks to the high polarization discrimination capability of the DDL antenna (specifically, thanks to the high polarization discrimination achievable between right hand circular polarization (RHCP) and left hand circular polarization (LHCP)).

A further advantage is the technology compatibility with high power, and higher frequency/larger bands migration. In particular, the integrated DDL and TT&C antenna system according to the second aspect of the present invention is compatible with current and future spectra allocated to the DDL and TT&C services.

In conclusion, it is clear that numerous modifications and variants can be made to the present invention, all falling within the scope of the invention, as defined in the appended claims.

The invention claimed is:

1. Antenna system (2,3,4) for use on board a satellite or space platform for data downlink and for telemetry, tracking and command, comprising a first antenna (21,31,41) and a second antenna (22, 32, 42), wherein said second antenna (22, 32, 42) is coaxially aligned with, and is arranged on top of, the first antenna (21,31,41);

wherein the first antenna (21,31,41) is a first double-reflector antenna comprising a first main reflector (211, 311,411) and a first sub-reflector (212, 312) arranged coaxially with, and in front of, one another;

the first antenna (21,31,41) further comprising a first coaxial feeder, that is arranged coaxially with the first main reflector (211,311,411), the first sub-reflector (212, 312) and the second antenna (22, 32, 42), and that includes an outer conductor (23, 33) and a first inner conductor (24, 34) which are arranged coaxially with, and spaced apart from, one another;

wherein the first coaxial feeder is designed to be fed with first downlink microwave signals to be transmitted by the first antenna (21,31,41), and to radiate said first downlink microwave signals through a first feed aperture (232,332), that is located centrally with respect to the first main reflector (211,311,411) and that gives onto the first sub-reflector (212, 312);

wherein the first inner conductor (24, 34) protrudes coaxially and outwardly from the first feed aperture (232, 332) up to the first sub-reflector (212, 312) and is rigidly coupled to said first sub-reflector (212, 312) thereby supporting said first sub-reflector (212, 312); and wherein a transmission line is provided in the first inner conductor (24, 34) to feed the second antenna (22, 32, 42) with second downlink microwave signals to be transmitted by said second antenna (22,32,42);

wherein the first antenna (21,31) is designed to operate in X band for telemetry, tracking and command, thereby resulting in the first downlink microwave signals being telemetry, tracking and command downlink signals having frequencies comprised within the X band;

wherein the first coaxial feeder is designed also to receive through the first feed aperture (232,332), and to allow propagation of, uplink microwave signals that are telemetry, tracking and command uplink signals received by the first antenna (21,31) and having frequencies comprised within the X band;

wherein the second antenna (22, 32) is designed to operate in K band for data downlink, thereby resulting in the second downlink microwave signals being data downlink signals having frequencies comprised within the K band;

wherein said second antenna (22, 32) is a second double-reflector antenna comprising a second main reflector (221, 321) and a second sub-reflector (222, 322) arranged coaxially with, and in front of, one another;

wherein the second main reflector (221, 321) is arranged on top of the first sub-reflector (212, 312);

wherein the first main reflector (211,311), the first sub-reflector (212, 312), the second main reflector (221, 321), the second sub-reflector (222, 322), the first coaxial feeder and the transmission line are arranged coaxially with one another;

wherein the outer conductor (23) is internally hollow and ends with the first feed aperture (232);

wherein the first inner conductor (24) is internally hollow and includes a first portion, that coaxially extends inside the outer conductor (23) up to the first feed aperture (232) and is spaced apart from the outer conductor (23);

wherein a first air gap is present between the outer conductor (23) and the first portion of the first inner conductor (24);

wherein the outer conductor (23), the first portion of the first inner conductor (24) and the first air gap define the first coaxial feeder;

wherein the first inner conductor (24) includes also a second portion that:

extends from the first portion of said first inner conductor (24), protruding coaxially and outwardly from the first feed aperture (232) up to a central portion of the first sub-reflector (212);

is coupled rigidly and electrically to said central portion of the first sub-reflector (212), thereby resulting in said first sub-reflector (212) being supported by said first inner conductor (24) and also being self-grounded; and extends also over said first sub-reflector (212) up to the second main reflector (221), ending with a second feed aperture (242), that is located centrally with respect to the second main reflector (221) and that gives onto the second sub-reflector (222);

the antenna system (2) further comprising a second inner conductor (25), which includes a first portion that axially extends inside the first inner conductor (24) up to the second feed aperture (242) and that is spaced apart from the first inner conductor (24);

wherein a second air gap is present between the first inner conductor (24) and the first portion of the second inner conductor (25);

wherein the first inner conductor (24), the first portion of the second inner conductor (25) and the second air gap define the transmission line thereby resulting in said transmission line being a second coaxial feeder;

wherein the second inner conductor (25) includes also a second portion that:

extends from the first portion of said second inner conductor (25), protruding axially and outwardly from the second feed aperture (242) up to a central portion of the second sub-reflector (222); and is coupled rigidly and electrically to said central portion of the second sub-reflector (222), thereby resulting in said second sub-reflector (222) being supported by said second inner conductor (25) and also being self-grounded.

2. The antenna system of claim 1, wherein the outer conductor (23, 33) is internally hollow and ends with the first feed aperture (232, 332);

wherein the first inner conductor (24, 34) is internally hollow and includes a first portion, that coaxially extends inside the outer conductor (23, 33) up to the first feed aperture (232, 332) and is spaced apart from the outer conductor (23,33);

wherein a first air gap is present between the outer conductor (23, 33) and the first portion of the first inner conductor (24,34);

wherein the outer conductor (23,33), the first portion of the first inner conductor (24, 34) and the first air gap define the first coaxial feeder;

wherein the first inner conductor (24, 34) includes also a second portion, that extends from the first portion of said first inner conductor (24, 34), protruding coaxially and outwardly from the first feed aperture (232, 332) up to a central portion of the first sub-reflector (212, 312);

wherein the second portion of the first inner conductor (24, 34) is coupled rigidly and electrically to said central portion of the first sub-reflector (212, 312), thereby resulting in said first sub-reflector (212, 312) being supported by said first inner conductor (24, 34) and also being self-grounded;

wherein the second antenna (22, 32, 42) is arranged on top of the first sub-reflector (212, 312);

and wherein the transmission line extends inside the first inner conductor (24, 34) and also over the first sub-reflector (212, 312) up to said second antenna (22, 32, 42) to feed the latter with the second downlink microwave signals.

3. The antenna system according to claim 1, wherein the second antenna is one of the following antennas: a double-reflector antenna (22,32), a helix antenna (42), a patch antenna, or a waveguide aperture radiator.

4. The antenna system according to claim 1, wherein the transmission line is one of the following transmission lines: a circular coaxial waveguide, a square coaxial waveguide, a rectangular coaxial waveguide, a coaxial cable, a circular waveguide, a square waveguide, or a rectangular waveguide.

5. The antenna system according to claim 1, wherein the first antenna (21,31,41) and the second antenna (22, 32, 42) are designed to operate one in X or K band for data downlink and the other in S or X band for telemetry, tracking and command.

6. The antenna system of claim 1, wherein the first main reflector (211, 311) and the first sub-reflector (212, 312) are spaced apart from one another by a first distance smaller than a first given minimum wavelength of the first downlink and uplink microwave signals;

and wherein the second main reflector (221, 321) and the second sub-reflector (222, 322) are spaced apart from one another by a second distance smaller than a second given minimum wavelength of the second downlink microwave signals.

7. The antenna system of claim 1, wherein the first and second coaxial feeders are circular coaxial waveguides, and wherein the second coaxial feeder is designed to be fed with, to allow propagation of, and to radiate two coaxial modes in quadrature.

8. The antenna system according to claim 1, wherein the first antenna (41) is designed to operate in X band for data downlink; wherein the second antenna is a helix antenna (42) designed to operate in S or X band for telemetry, tracking and command; and wherein the transmission line is a coaxial cable.

9. The antenna system according to claim 1, wherein the first antenna (41) is designed to operate in X band for data downlink, and wherein the second antenna is a patch antenna designed to operate in S or X band for telemetry, tracking and command.

10. The antenna system according to claim 1, wherein the first antenna (41) is designed to operate in X band for data downlink, and wherein the second antenna is a waveguide aperture radiator designed to operate in the X band for telemetry, tracking and command.

11. The double-reflector antenna (1) of claim 1, wherein the double-reflector antenna is associated with a satellite.

12. The double-reflector antenna (1) of claim 1, wherein the double-reflector antenna is associated with a space platform.

13. The double-reflector antenna according to claim 1, wherein the antenna system is associated with a satellite.

14. The double-reflector antenna according to claim 1, wherein the antenna system is associated with a space platform.

15. Antenna system (2,3,4) for use on board a satellite or space platform for data downlink and for telemetry, tracking and command, comprising a first antenna (21,31,41) and a second antenna (22, 32, 42), wherein said second antenna (22, 32, 42) is coaxially aligned with, and is arranged on top of, the first antenna (21,31,41);

wherein the first antenna (21,31,41) is a first double-reflector antenna comprising a first main reflector (211, 311,411) and a first sub-reflector (212, 312) arranged coaxially with, and in front of, one another;

the first antenna (21,31,41) further comprising a first coaxial feeder, that is arranged coaxially with the first main reflector (211,311,411), the first sub-reflector (212, 312) and the second antenna (22, 32, 42), and that includes an outer conductor (23, 33) and a first inner conductor (24, 34) which are arranged coaxially with, and spaced apart from, one another;

wherein the first coaxial feeder is designed to be fed with first downlink microwave signals to be transmitted by the first antenna (21,31,41), and to radiate said first downlink microwave signals through a first feed aperture (232,332), that is located centrally with respect to the first main reflector (211,311,411) and that gives onto the first sub-reflector (212, 312);

wherein the first inner conductor (24, 34) protrudes coaxially and outwardly from the first feed aperture (232, 332) up to the first sub-reflector (212, 312) and is rigidly coupled to said first sub-reflector (212, 312) thereby supporting said first sub-reflector (212, 312); and wherein a transmission line is provided in the first inner conductor (24, 34) to feed the second antenna (22, 32, 42) with second downlink microwave signals to be transmitted by said second antenna (22,32,42);

wherein the first antenna (21,31) is designed to operate in X band for telemetry, tracking and command, thereby resulting in the first downlink microwave signals being telemetry, tracking and command downlink signals having frequencies comprised within the X band;

wherein the first coaxial feeder is designed also to receive through the first feed aperture (232,332), and to allow propagation of, uplink microwave signals that are telemetry, tracking and command uplink signals received by the first antenna (21,31) and having frequencies comprised within the X band;

wherein the second antenna (22, 32) is designed to operate in K band for data downlink, thereby resulting in the second downlink microwave signals being data downlink signals having frequencies comprised within the K band;

wherein said second antenna (22, 32) is a second double-reflector antenna comprising a second main reflector (221, 321) and a second sub-reflector (222, 322) arranged coaxially with, and in front of, one another;

wherein the second main reflector (221, 321) is arranged on top of the first sub-reflector (212, 312);

wherein the first main reflector (211,311), the first sub-reflector (212, 312), the second main reflector (221, 321), the second sub-reflector (222, 322), the first coaxial feeder and the transmission line are arranged coaxially with one another;

wherein the outer conductor (33) is internally hollow and ends with the first feed aperture (332)

wherein the first inner conductor (34) is internally hollow and includes a first portion, that coaxially extends inside the outer conductor (33) up to the first feed aperture (332) and is spaced apart from the outer conductor (33);

wherein a first air gap is present between the outer conductor (33) and the first portion of the first inner conductor (34);

wherein the outer conductor (33), the first portion of the first inner conductor (34) and the first air gap define the first coaxial feeder;

wherein the first inner conductor (34) includes also a second portion that:

extends from the first portion of said first inner conductor (34), protruding coaxially and outwardly from the first feed aperture (332) up to a central portion of the first sub-reflector (312); and ends with a stepped transition portion (342) that is coupled rigidly and electrically to said central portion of the first sub-reflector (312), thereby resulting in said first sub-reflector (312) being supported by said first inner conductor (34) and also being self-grounded;

the antenna system (2) further comprising a dielectric structure, that includes:

a first portion (351) axially extending from the stepped transition portion (342) of the first inner conductor (34), over the first sub-reflector (312) up to the second main reflector (321); and a second portion (352) that extends from the first portion (351) of said dielectric structure protruding coaxially and outwardly from the second main reflector (321) up to the second sub-reflector (322), said second portion (352) of said dielectric structure being rigidly coupled to the second sub-reflector (322) thereby supporting said second sub-reflector (322);

and wherein the first inner conductor (34) and the dielectric structure define the transmission line.

16. The antenna system of claim 15, wherein the second portion (352) of the dielectric structure is cone-shaped, and wherein the second sub-reflector (322) is a sputtered metallic sub-reflector arranged on top of, and supported by, said cone-shaped second portion (352) of the dielectric structure.

17. The antenna system of claim 16, wherein the second sub-reflector (322) is a sputtered aluminium sub-reflector.

18. The antenna system according to claim 15, wherein the first coaxial feeder is a circular coaxial waveguide, and wherein the transmission line is designed to be fed with, to allow propagation of, and to radiate two circular modes in quadrature.

19. The double-reflector antenna (1) of claim 15, wherein the double-reflector antenna is associated with a satellite.

20. The double-reflector antenna (1) of claim 15, wherein the double-reflector antenna is associated with a space platform.

21. The double-reflector antenna according to claim 15, wherein the antenna system is associated with a satellite.

22. The double-reflector antenna according to claim 15, wherein the antenna system is associated with a space platform.

* * * * *